US010395817B2

(12) United States Patent
Yoon et al.

(10) Patent No.: US 10,395,817 B2
(45) **Date of Patent: *Aug. 27, 2019**

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Jong Sik Yoon, Suwon-si (KR); Byeong Cheol Moon, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/880,996

(22) Filed: Jan. 26, 2018

(65) Prior Publication Data

US 2018/0151289 A1 May 31, 2018

Related U.S. Application Data

(63) Continuation of application No. 15/229,587, filed on Aug. 5, 2016, now Pat. No. 10,020,112.

(30) Foreign Application Priority Data

Dec. 18, 2015 (KR) ..... 10-2015-0181757

(51) Int. Cl.
*H01F 5/00* (2006.01)
*H01F 27/29* (2006.01)
(Continued)

(52) U.S. Cl.
CPC ..... *H01F 27/292* (2013.01); *H01F 17/0013* (2013.01); *H01F 17/04* (2013.01);
(Continued)

(58) Field of Classification Search
USPC ..... 336/200
See application file for complete search history.

(56) References Cited

U.S. PATENT DOCUMENTS 6,713,162 B2 3/2004 Takaya et al.
7,023,299 B2 4/2006 Shoji
(Continued)

FOREIGN PATENT DOCUMENTS

CN 103065764 A 4/2013
CN 103366920 A 10/2013
(Continued)

OTHER PUBLICATIONS

English translation of JP11054336.*
(Continued)

*Primary Examiner* — Ronald Hinson
(74) *Attorney, Agent, or Firm* — Morgan, Lewis & Bockius LLP

(57) ABSTRACT

A coil component and a method of manufacturing the same are provided. The coil component may include a body part containing a magnetic material, a coil part disposed in the body part, and an electrode part disposed on the body part. The coil part includes a support member, a coil disposed on a surface of the support member and having a terminal exposed to at least one outer surface of the body part, and a conductive via connected to the terminal of the coil and penetrating through at least one end portion of the support member to thereby be exposed to the at least one outer surface of the body part.

21 Claims, 15 Drawing Sheets

(51) Int. Cl.

| | |
|---|---|
| ***H01F 27/28*** | (2006.01) |
| ***H01F 27/255*** | (2006.01) |
| ***H01F 41/04*** | (2006.01) |
| ***H01F 41/10*** | (2006.01) |
| ***H01F 17/00*** | (2006.01) |
| ***H01F 17/04*** | (2006.01) |

(52) U.S. Cl.
CPC ..... *H01F 27/255* (2013.01); *H01F 27/2804* (2013.01); *H01F 41/041* (2013.01); *H01F 41/10* (2013.01); *H01F 2017/048* (2013.01)

(56) References Cited

U.S. PATENT DOCUMENTS

| | | | | |
|---|---|---|---|---|
| 8,174,349 | B2 | 5/2012 | Yoshida et al. | |
| 2007/0290782 | A1 | 12/2007 | Yokoyama et al. | |
| 2013/0249664 | A1* | 9/2013 | Tonoyama | H01F 41/04 336/200 |
| 2014/0009254 | A1 | 1/2014 | Ohkubo et al. | |
| 2014/0184374 | A1* | 7/2014 | Park | H01F 27/255 336/83 |
| 2015/0035640 | A1 | 2/2015 | Wang et al. | |
| 2015/0270053 | A1 | 9/2015 | Cha et al. | |
| 2016/0343489 | A1 | 11/2016 | Horikawa et al. | |

FOREIGN PATENT DOCUMENTS

| | | | |
|---|---|---|---|
| CN | 104347262 | A | 2/2015 |
| JP | H10-97913 | A | 4/1998 |
| JP | H11-054336 | A | 2/1999 |
| JP | 2002-110425 | A | 4/2002 |
| JP | 2004-207747 | A | 7/2004 |
| JP | 2012089760 | A | 5/2012 |
| JP | 2013-089876 | A | 5/2013 |
| JP | 2013225718 | A | 10/2013 |
| JP | 2014-127624 | A | 7/2014 |
| JP | 2015-126199 | A | 7/2015 |
| JP | 2015135926 | A | 7/2015 |
| JP | 2016219579 | A | 12/2016 |
| KR | 10-2014-0005088 | A | 1/2014 |
| KR | 10-2014-0038780 | A | 3/2014 |
| KR | 10-2015-0071266 | A | 6/2015 |
| KR | 10-1565700 | B1 | 11/2015 |
| KR | 20160136236 | A | 11/2016 |

OTHER PUBLICATIONS

Notification of Reasons of Refusal issued in Japanese Patent Application No. 2016-159389, dated May 8, 2018 (English translation).
Notice of Allowance issued in U.S. Appl. No. 15/229,587, dated Feb. 2, 2018.
Korean Office Action dated Feb. 2, 2017, issued in Korean Patent Application No. 10-2015-0181757. (w/ English translation).
Japanese Office Action dated Aug. 8, 2017, issued in Japanese Patent Application No. 2016-159389 (w/ English translation).
Office Action issued in corresponding Chinese Patent Application No. 201610794914.9, dated Jan. 30, 2018 (With English Translation).
Second Office Action issued in Chinese Patent Application No. 201610794914.9, dated Jul. 27, 2018 (English translation).
Third Office Action issued in corresponding Chinese Patent Application No. 201610794914.9 dated Mar. 8, 2019, with English translation.

* cited by examiner

COIL COMPONENT AND METHOD OF MANUFACTURING THE SAME

CROSS-REFERENCE TO RELATED APPLICATION

This application is a continuation of U.S. patent application Ser. No. 15/229,587 filed Aug. 5, 2016, which claims priority and benefit of Korean Patent Application No. 10-2015-0181757, filed on Dec. 18, 2015 with the Korean Intellectual Property Office. The subject matter of both applications are incorporated herein by reference.

BACKGROUND

The present disclosure relates to a coil component and a method of manufacturing the same.

In parallel with the miniaturization and slimming of electronic devices such as digital TVs, mobile phones, laptop PCs, and the like, there has also been a demand for miniaturization and slimming of coil components used in these electronic devices. In order to satisfy this demand, research into winding type or thin film type coil components having various shapes has been actively conducted.

In general, a thin film type coil component may be manufactured by forming a coil on an insulating substrate, embedding the insulating substrate and the coil formed on the insulating substrate with a magnetic material, grinding an outer surface of a formed magnetic body, and forming electrodes on the outer surface of the magnetic body.

In a case of manufacturing the coil component using the method as described above, an end portion of the insulating substrate is exposed to the outer surface of the magnetic body together with a terminal of the coil. However, it is difficult to form a plating layer on the insulating substrate, and the resulting device may thus include defects such as a contact defects or the like. Such defects may occur even when a subsequent process, such as application of a conductive paste or the like, is performed after plating for forming the electrodes.

SUMMARY

An aspect of the present disclosure may provide a coil component capable of decreasing a defect when plating is performed, or the like, due to a novel structure in which an insulating substrate is not exposed to an outer surface of a body on which electrodes are formed.

According to an aspect of the present disclosure, a coil component may include a conductive via formed on an end portion of an insulating substrate exposed to an outer surface of a body on which an electrode is formed, and thus the insulating substrate may not be exposed to the outer surface of the body.

In detail, in accordance with one aspect of the disclosure, a coil component includes a body part containing a magnetic material, a coil part disposed in the body part, and an electrode part disposed on the body part. The coil part includes a support member, a coil disposed on a surface of the support member and having a terminal exposed to at least one outer surface of the body part, and a conductive via connected to the terminal of the coil and penetrating through at least one end portion of the support member to thereby be exposed to the at least one outer surface of the body part.

In accordance with another aspect of the disclosure, a method of manufacturing a coil component includes forming a coil part by providing a support member, forming a coil having a terminal on at least one surface of the support member, and forming a conductive via connected to the terminal of the coil and penetrating through at least one end portion of the support member. A body part is then formed by embedding the coil part with a magnetic material. In turn, an electrode part is formed by forming, on the body part, an electrode connected to the terminal of the coil and to the conductive via. The terminal of the coil and the conductive via are exposed to at least one outer surface of the body part, and the electrode is connected to the terminal of the coil and the conductive via on the at least one outer surface of the body part.

In accordance with a further aspect of the disclosure, a coil component includes a support member, a coil disposed in a planar coil pattern on a surface of the support member, and a body part containing a magnetic material and enclosing the coil and the support member. The coil includes at least one coil terminal exposed to an outer surface of the body part, and the support member is spaced apart from all outer surfaces of the body part.

In accordance with another aspect of the disclosure, a method includes forming a coil disposed in a planar coil pattern on a surface of a support member, and forming a conductive via connected to the coil and penetrating through the support member. A body part containing a magnetic material is formed to enclose the coil, the conductive via, and the support member. The body part enclosing the coil, the conductive via, and the support member is then diced along a dicing line that extends through the conductive via.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
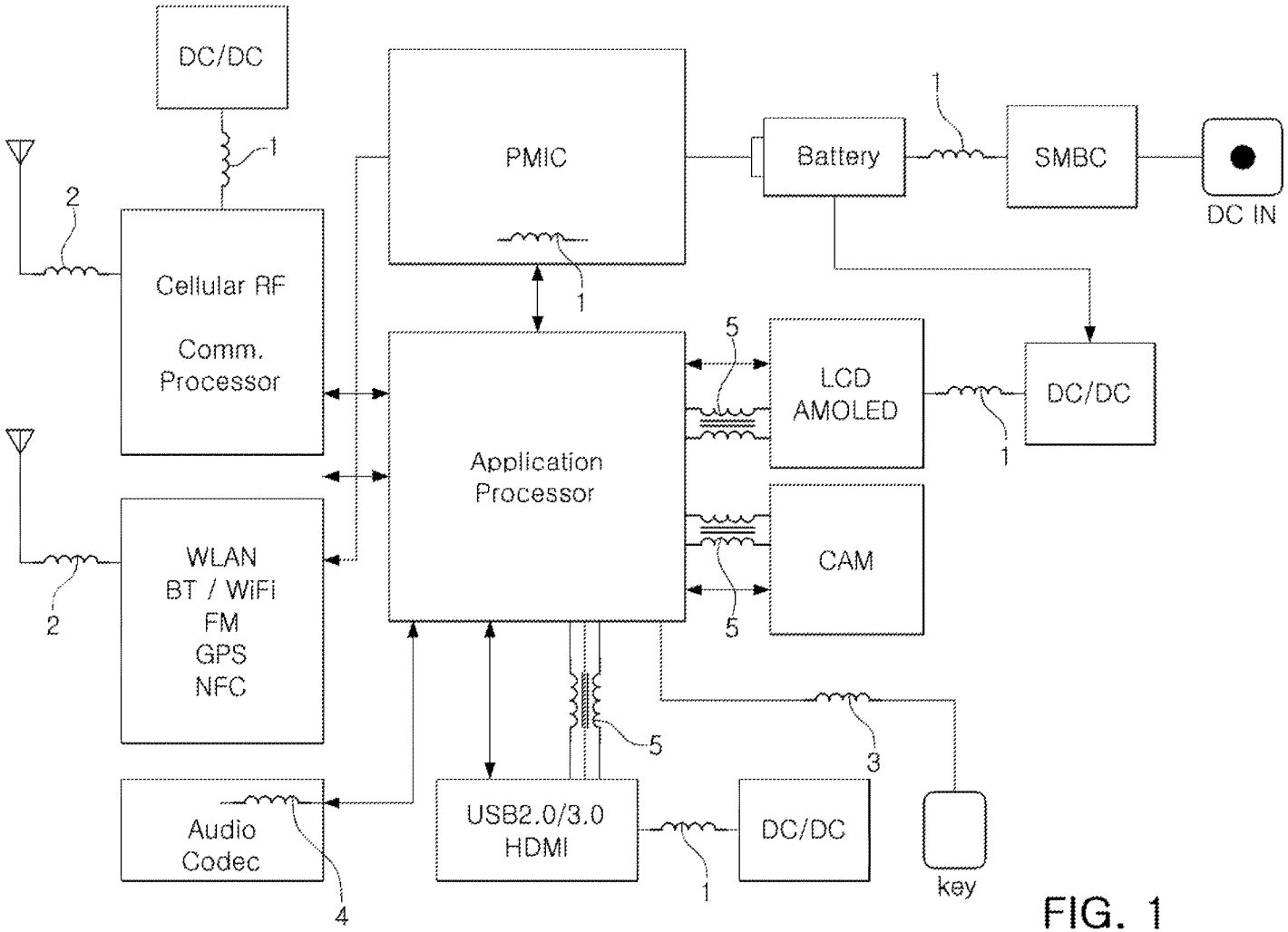
FIG. 1 schematically illustrates an example of a coil component used in an electronic device.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be limited by these terms. These terms are only used to distinguish one member, component, region, layer, or section from another member, component, region, layer, or section. Thus, a first member, component, region, layer, or section discussed below could be termed a second member, component, region, layer, or section without departing from the teachings of the exemplary embodiments.

Spatially relative terms, such as "above," "upper," "below," "lower," and the like, may be used herein for ease of description to describe one element's positional relationship relative to one or more other element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the devices, elements, or figures. The device may be otherwise oriented (rotated 90 degrees or at other orientations) and the spatially relative descriptors used herein may be interpreted accordingly.

The terminology used herein describes particular illustrative embodiments only, and the present disclosure is not limited thereby. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, members, elements, and/or groups, but do not preclude the presence or addition of one or more other features, integers, steps, operations, members, elements, and/or groups.

Hereinafter, embodiments of the present disclosure will be described with reference to schematic views illustrating embodiments of the present disclosure. In the drawings, components having ideal shapes are shown. However, variations from these shapes, for example due to variability in manufacturing techniques and/or tolerances, also fall within the scope of the disclosure. Thus, embodiments of the present disclosure should not be construed as being limited to the particular shapes of regions shown herein, but should more generally be understood to include changes in shape resulting from manufacturing methods and processes. The following embodiments may also be constituted by one or a combination thereof.

The present disclosure describes a variety of configurations, and only illustrative configurations are shown herein. However, the disclosure is not limited to the particular illustrative configurations presented herein, but extends to other similar/analogous configurations as well.

Electronic Device

FIG. 1 schematically illustrates an example of a coil component used in an electronic device. Referring to FIG. 1, it may be appreciated that various kinds of electronic components are used in the electronic device. For example, the electronic device of FIG. 1 includes, in addition to various coil components, one or more of an application processor, a direct current (DC) to DC converter, a communications processor, one or more transceivers configured for communication using a wireless local area network (WLAN), Bluetooth (BT), wireless fidelity (Wi-Fi), frequency modulation (FM), global positioning system (GPS), and/or near field communications (NFC) standard, a power management integrated circuit (PMIC), a battery, a switch-mode battery charger (SMBC), a liquid crystal display (LCD) and/or active matrix organic light emitting diode (AMOLED) display, an audio codec, a universal serial bus (USB) 2.0/3.0 interface and/or a high definition multimedia interface (HDMI), or a conditional access module (CAM), or the like. In this case, in order to remove noise, or the like, various kinds of coil components may be appropriately used between these electronic components and/or in the electronic device depending on the use. For example, the coil components can include power inductors 1, high-frequency (HF) inductors 2, general beads 3, high frequency or GHz beads 4, common mode filters 5, or the like.

In detail, the power inductors 1 may be used for stabilizing power by storing electricity in a form of a magnetic field to maintain an output voltage, etc. Further, the HF inductors 2 may be used for matching impedance to secure a frequency to be required, or blocking noise and alternating current component, etc. In addition, the general beads 3 may be used for removing noise in power and signal lines or removing high frequency ripples, etc. Further, the high frequency or GHz beads 4 may be used for removing high-frequency noise in power and signal lines associated with audio, etc. In addition, the common mode filters 5 may be used for passing a current in a differential mode and removing only common mode noise, etc.

A representative example of the electronic device may be a smartphone, but is not limited thereto. For example, the electronic device may be a personal digital assistant, a digital video camera, a digital still camera, a network system, a computer, a monitor, a television, a video game console, or a smart watch. In addition, various other electronic devices and the like may use coil components such as those described herein.

Coil Component

Hereinafter, a coil component according to the present disclosure will be described in more detail. For convenience, a structure of an inductor will be described by way of example, but the coil component may be used as other types of components for various purposes as described above. Meanwhile, hereinafter, the term "side portion" is used to indicate a portion located toward a first (lateral) or second (lateral) direction, the term "upper portion" is used to indicate a portion located toward a third (upward) direction, and the term "lower portion" is used to indicate a portion locate in a (downward) direction opposite to the third (upward) direction. In addition, the term "positioned to the side portion, the upper portion, or the lower portion" may include a case in which a target component is disposed in the corresponding direction but does not directly contact a component located in the side, upper, or lower portion, as well as a case in which the target component directly contacts the corresponding component in the corresponding direction. However, the directions detailed above are defined only for convenience of explanation, and the scope of the present disclosure is not particularly limited by the description of the directions as described above.

Figure 2:
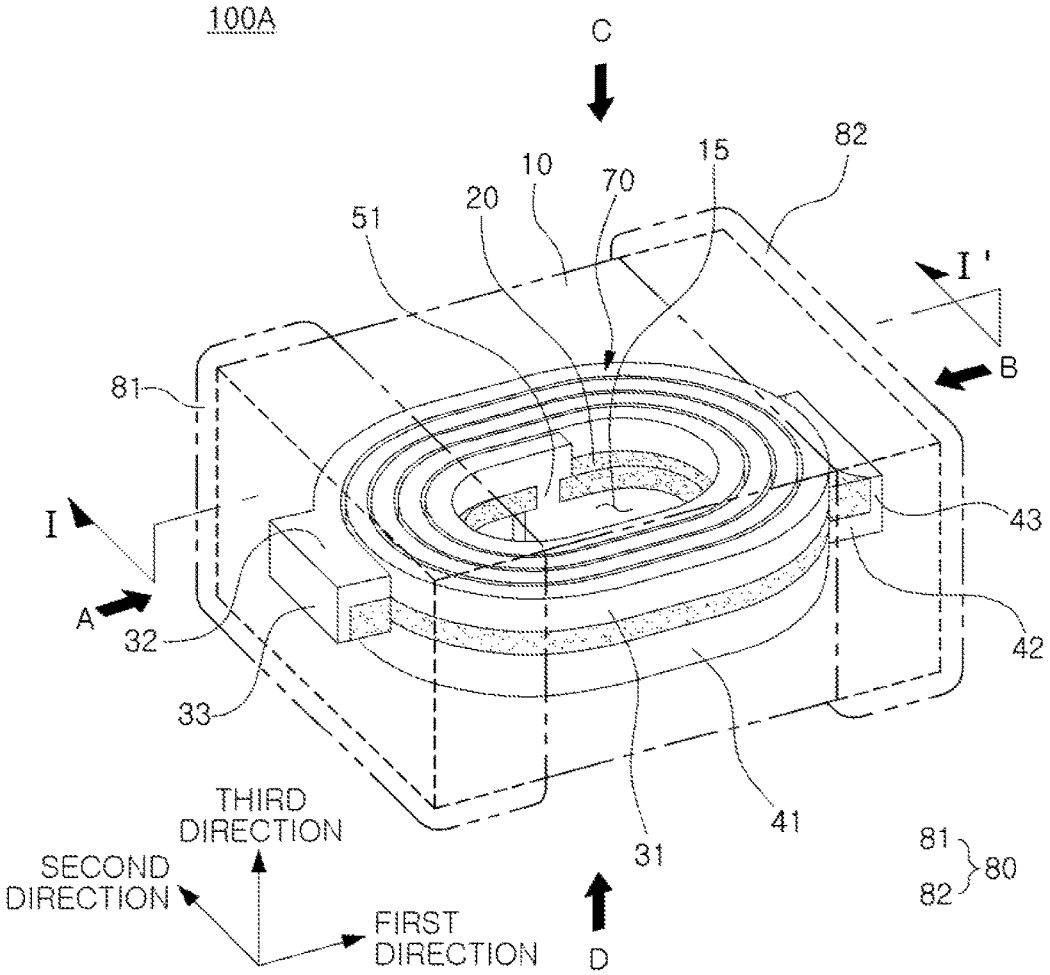
FIG. 2 is a schematic perspective view illustrating an example of the coil component.
Figure 3:
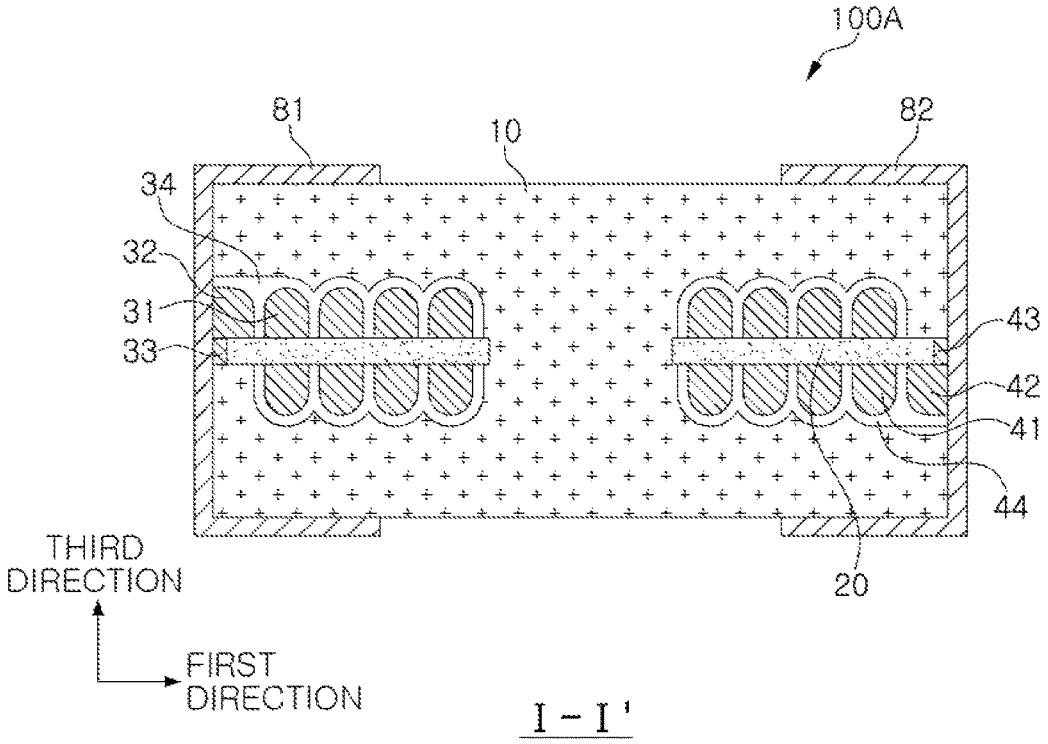
FIG. 3 illustrates a schematic cross-section of the coil component of FIG. 2 taken along line I-I'.

FIG. 2 is a schematic perspective view illustrating an example of the coil component. FIG. 3 illustrates a schematic cross-section of the coil component of FIG. 2 taken along line I-I'. Referring to FIGS. 2 and 3, a coil component 100A according to the example may include a body part 10, a coil part 70 disposed in the body part 10, and one or more electrode part(s) 80 disposed on the body part 10. The coil part 70 may include a support member 20, a first coil 31 and 32 and a second coil 41 and 42 disposed on respective surfaces of the support member 20, first and second conductive vias 33 and 43 penetrating through respective end portions of the support member 20, a through via 51 connecting the first coil 31 and 32 and the second coil 41 and 42 to each other while penetrating through the support member 20, and first and second insulating films 34 and 44 respectively covering the first coil 31 and 32 and the second coil 41 and 42. The one or more electrode part(s) 80 may include first and second electrodes 81 and 82 disposed on the body part 10 to be spaced apart from each other.

Meanwhile, as described above, in accordance with miniaturization and slimming of electronic devices, there has also been a demand for miniaturization and slimming of coil components used in these electronic devices. In order to satisfy this demand, research into a thin film type coil component has been actively conducted. In such devices, an end portion of an insulating substrate is generally exposed to an outer surface of a magnetic body together with a terminal of a coil. The end portion of the insulating substrate is exposed to the outer surface of the substrate due to characteristics of a method of manufacturing the thin film type coil component. As a result of the insulating substrate being exposed, a problem such as a plating defect or the like may occur when an electrode is formed on the outer surface of the substrate on which the insulating substrate is exposed.

In contrast, in the coil component 100A according to the example, the first and second conductive vias 33 and 43 may completely penetrate through a dicing surface of the support member 20 contacting first and second surfaces of the body part 10. As a result, the support member 20 may not be substantially exposed to the first and second surfaces of the body part 10. Therefore, since the electrode(s) 80 are formed of a conductive material, the plating defects or other problems resulting from the exposed substrate may not occur. Here, the term "substantially" is used to indicate that a situation in which a small portion of the support member 20 remains unintentionally exposed to the outer surface of the body part 10 due to a process limitation, or the like, can fall within the scope of the structure of FIGS. 2 and 3.

Hereinafter, the configurations of the coil component 100A according to the example will be described in more detail.

The body part 10 may form an exterior of the coil component 100A and have first and second (end) surfaces opposing each other in the first (length) direction, third and fourth (side) surfaces opposing each other in the second (width) direction, and fifth (upper) and sixth (lower) surfaces opposing each other in the third (height/vertical) direction. The body part 10 may have a hexahedral shape as described above. However, a shape of the body part 10 is not limited thereto. The body part 10 may contain a magnetic material. The magnetic material is not particularly limited as long as it has magnetic properties. Examples of the magnetic material may include pure iron powder; Fe alloys such as Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Ni—Cr based alloy powder, Fe—Cr—Al based alloy powder, or the like; amorphous alloys such as an Fe based amorphous alloy, a Co based amorphous alloy, or the like; spinel type ferrites such as a Mg—Zn based ferrite, a Mn—Zn based ferrite, a Mn—Mg based ferrite, a Cu—Zn based ferrite, a Mg—Mn—Sr based ferrite, a Ni—Zn based ferrite, or the like; hexagonal ferrites such as a Ba—Zn based ferrite, a Ba—Mg based ferrite, a Ba—Ni based ferrite, a Ba—Co based ferrite, a Ba—Ni—Co based ferrite, or the like; or garnet ferrites such as an Y based ferrite, or the like.

The coil part 70 may provide the coil characteristics to the coil component 100A. The coil part 70 may include the support member 20, the first coil 31 and 32 disposed on one surface of the support member 20 and having a first terminal 32 led (or exposed) to the first surface of the body part 10, the second coil 41 and 42 disposed on another surface of the support member 20 opposite to the one surface and having a second terminal 42 led (or exposed) to the second surface of the body part 10, the first conductive via 33 penetrating through a first end portion of the support member 20 and connected to the first terminal 32 of the first coil 31 and 32 to thereby be led (or exposed) to the first surface of the body part 10, and the second conductive via 43 penetrating through a second end portion of the support member 20 and connected to the second terminal 42 of the second coil 41 and 42 to thereby be led (or exposed) to the second surface of the body part 10. Further, the coil part 70 may include the through via 51 connecting the first coil 31 and 32 and the second coil 41 and 42 to each other while penetrating through the support member 20. Further, the coil part 70 may include the first insulating film 34 covering the first coil 31 and 32 and the second insulating film 44 covering the second coil 41 and 42.

The support member 20 is used to more easily form the coils 31, 32, 41, and 42 to be thin. The support member 20 may be an insulating substrate formed of an insulating resin. In this case, as the insulating resin, a thermosetting resin such as an epoxy resin, a thermoplastic resin such as polyimide, resins in which a reinforcement material, such as a glass fiber or an inorganic filler, is impregnated in the thermosetting resin and the thermoplastic resin, such as pre-preg, an Ajinomoto build-up film (ABF), FR-4, a bis-maleimide triazine (BT) resin, a photo imageable dielectric (PID) resin, or the like, may be used. In a case in which the glass fiber is contained in the support member 20, rigidity may be further improved.

The through via 51 may electrically connect the first coil 31 and 32 and the second coil 41 and 42 to each other, thereby forming a single coil having two windings rotating in the same direction. The through via 51 may be a plating pattern formed by a general plating method after forming a through hole extending through the support member 20, but is not limited thereto. In some cases, the first coil 31 and 32 and/or the second coil 41 and 42 and the through via 51 may be simultaneously formed to thereby be integrated with each other, but are not limited thereto. The through via 51 may be composed of a seed layer and a plating layer. As a material of the seed layer and the plating layer, a conductive material such as copper (Cu), aluminum (Al), silver (Ag), tin (Sn), gold (Au), nickel (Ni), lead (Pb), alloys thereof, or the like, which is a general plating material, may be used.

A shape of a horizontal cross section of the through via 51 (e.g., in a plane extending along the first and second directions) is not particularly limited, but may be, for example, a circular shape, an oval shape, a polygonal shape, or the like. A shape of a perpendicular cross section of the through via 51 (e.g., in a plane extending along the first and third directions, or along the second and third directions) is not particularly limited, but may be, for example, a tapered shape, a reversely tapered shape, an hourglass shape, a pillar shape, or the like. Generally, a substrate containing glass fiber and an insulating resin, such as pre-preg, or the like, may be used as the support member 20. In this case, the through via 51 may have the hourglass shape, but is not necessarily limited thereto.

The first coil 31 and 32 may have a first plating pattern 31 having a planar coil shape disposed on the one surface of the support member 20. The first plating pattern 31 having the planar coil shape may be a plating pattern formed by a general isotropic plating method, but is not limited thereto. The first plating pattern 31 having the planar coil shape may have at least two turns, thereby implementing high inductance while having a reduced thickness. The first plating pattern 31 having the planar coil shape may be composed of a seed layer and a plating layer. As a material of the seed layer and the plating layer, a conductive material such as copper (Cu), aluminum (Al), silver (Ag), tin (Sn), gold (Au), nickel (Ni), lead (Pb), alloys thereof, or the like, which is a general plating material, may be used.

The first coil 31 and 32 may include the first terminal 32 led (or exposed) to the first surface of the body part 10. The first terminal 32 may also be a plating pattern formed by a general isotropic plating method, but is not limited thereto. The first terminal 32 is electrically connected to the first plating pattern 31. The first terminal 32 may be exposed to the first surface of the body part 10 to thereby be connected to the first electrode 81. The first terminal 32 may be composed of a seed layer and a plating layer. As a material of the seed layer and the plating layer, a conductive material such as copper (Cu), aluminum (Al), silver (Ag), tin (Sn), gold (Au), nickel (Ni), lead (Pb), alloys thereof, or the like, which is a general plating material, may be used.

The first conductive via 33 may be connected to the first terminal 32 of the first coil 31 and 32 and led (or exposed) to the first surface of the body part 10 together with the first terminal 32. The first conductive via 33 may be a plating pattern formed by a general plating method after forming a via hole extending through the support member 20, but is not limited thereto. In some cases, the first coil 31 and 32 and the first conductive via 33 may be simultaneously formed to thereby be integrated with each other, but are not limited thereto. The first conductive via 33 may be exposed to the first surface of the body part 10 to thereby be connected to the first electrode 81 together with the first terminal 32. The first conductive via 33 may be composed of a seed layer and a plating layer. As a material of the seed layer and the plating layer, a conductive material such as copper (Cu), aluminum (Al), silver (Ag), tin (Sn), gold (Au), nickel (Ni), lead (Pb), alloys thereof, or the like, which is a general plating material, may be used.

The first insulating film 34, the purpose of which is to protect and insulate the first coil 31 and 32 (e.g., insulate the first coil 31 and 32 from the material of the body part 10), may contain an insulating material. Any of a wide range of insulating materials may be contained in the first insulating film 34 without particular limitation. The first insulating film 34 may enclose a surface of the first coil 31 and 32, and a thickness, or the like, of the first insulating film 34 is not particularly limited. The first insulating film 34 may further extend between windings of the first coil 31 and 32 and insulate adjacent windings from each other.

The second coil 41 and 42 may have a second plating pattern 41 having a planar coil shape disposed on the other surface of the support member 20 (opposite to the one surface). The second plating pattern 41 having the planar coil shape may be a plating pattern formed by a general isotropic plating method, but is not limited thereto. The second plating pattern 41 having the planar coil shape may have at least two turns, thereby implementing high inductance while having a reduced thickness. The second plating pattern 41 having the planar coil shape may be composed of a seed layer and a plating layer. As a material of the seed layer and the plating layer, a conductive material such as copper (Cu), aluminum (Al), silver (Ag), tin (Sn), gold (Au), nickel (Ni), lead (Pb), alloys thereof, or the like, which is a general plating material, may be used.

The second coil 41 and 42 may include the second terminal 42 led (or exposed) to the second surface of the body part 10. The second terminal 42 may also be a plating pattern formed by a general isotropic plating method, but is not limited thereto. The second terminal 42 is electrically connected to the second plating pattern 41. The second terminal 42 may be exposed to the second surface of the body part 10 (opposite to the first surface) to thereby be connected to the second electrode 82. The second terminal 42 may be composed of a seed layer and a plating layer. As a material of the seed layer and the plating layer, a conductive material such as copper (Cu), aluminum (Al), silver (Ag), tin (Sn), gold (Au), nickel (Ni), lead (Pb), alloys thereof, or the like, which is a general plating material, may be used.

The second conductive via 43 may be connected to the second terminal 42 of the second coil 41 and 42 and led (or exposed) to the second surface of the body part 10 together with the second terminal 42. The second conductive via 43 may be a plating pattern formed by a general plating method after forming a via hole extending through the support member 20, but is not limited thereto. In some cases, the second coil 41 and 42 and the second conductive via 43 may be simultaneously formed to thereby be integrated with each other, but are not limited thereto. The second conductive via 43 may be exposed to the second surface of the body part 10 to thereby be connected to the second electrode 82 together with the second terminal 42. The second conductive via 43 may be composed of a seed layer and a plating layer. As a material of the seed layer and the plating layer, a conductive material such as copper (Cu), aluminum (Al), silver (Ag), tin (Sn), gold (Au), nickel (Ni), lead (Pb), alloys thereof, or the like, which is a general plating material, may be used.

The second insulating film 44, the purpose of which is to protect and insulate the second coil 41 and 42 (e.g., insulate the second coil 41 and 42 from the material of the body part 10), may contain an insulating material. Any of a wide range of insulating materials may be contained in the second insulating film 44 without particular limitation. The second insulating film 44 may enclose a surface of the second coil 41 and 42, and a thickness, or the like, of the second insulating film 44 is not particularly limited. The second insulating film 44 may further extend between windings of the second coil 41 and 42 and insulate adjacent windings from each other.

The one or more electrode part(s) 80 may serve to electrically connect the coil component 100A to an electronic device (or to other electronic components, wires, or circuit traces) when the coil component 100A is mounted in the electronic device. The one or more electrode part(s) 80 may include the first and second electrodes 81 and 82 disposed on the body part 10 to be spaced apart from each other. If necessary, as described below, each electrode part 80 may include a pre-plating layer (not illustrated) between the coil part 70 and the electrode part 80 in order to improve electrical reliability.

The first electrode 81 may be extended to portions of third, fourth, fifth, and sixth surfaces of the body part 10 while covering the first surface of the body part 10. The first electrode 81 may be connected to the first terminal 32 of the first coil 31 and 32 and the first conductive via 33 which are led (or exposed) to the first surface of the body part 10. The first electrode 81 may include, for example, a conductive resin layer and a conductor layer formed on the conductive resin layer. The conductive resin layer may be formed by printing a paste, or the like, and may contain any one or more conductive metals selected from the group consisting of copper (Cu), nickel (Ni), silver (Ag), and a thermosetting resin. The conductor layer may contain any one or more selected from the group consisting of nickel (Ni), copper (Cu), and tin (Sn). For example, a nickel (Ni) layer and a tin (Sn) layer may be sequentially formed by plating.

The second electrode 82 may be extended to portions of third, fourth, fifth, and sixth surfaces of the body part 10 while covering the second surface of the body part 10. The second electrode 82 may be connected to the second terminal 42 of the second coil 41 and 42 and the second conductive via 43 which are led (or exposed) to the second surface of the body part 10. The second electrode 82 may include, for example, a conductive resin layer and a conductor layer formed on the conductive resin layer. The conductive resin layer may contain any one or more conductive metals selected from the group consisting of copper (Cu), nickel (Ni), silver (Ag), and a thermosetting resin. The conductor layer may contain any one or more selected from the group consisting of nickel (Ni), copper (Cu), and tin (Sn). For example, a nickel (Ni) layer and a tin (Sn) layer may be sequentially formed by plating.

Figure 4A:
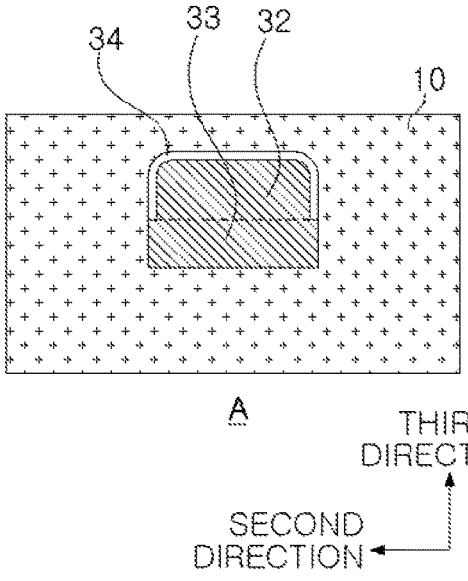
FIGS. 4A and 4B illustrate schematic examples of a body part of the coil component of FIG. 2 viewed in the A and B directions identified in FIG. 2.
Figure 4B:
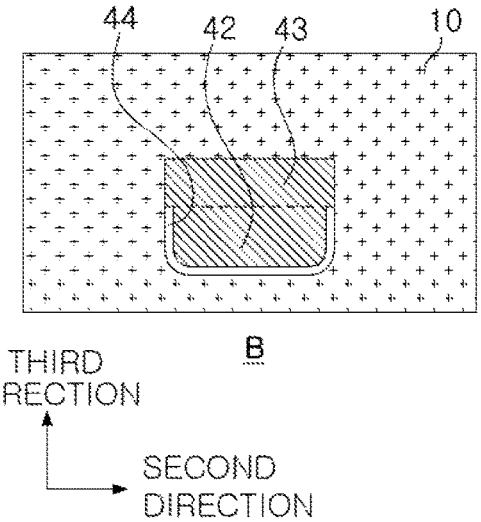

FIGS. 4A and 4B illustrate schematic examples of the body part 10 of the coil component of FIG. 2 viewed in the A and B directions, respectively, identified in FIG. 2. Here, FIG. 4A schematically illustrates the first surface of the body part 10. In addition, FIG. 4B schematically illustrates the second surface of the body part 10. Referring to FIGS. 4A and 4B, the first terminal 32 of the first coil 31 and 32, the first conductive via 33 connected to the first terminal 32, and the first insulating film 34 covering the first coil 31 and 32 may be exposed to the first surface of the body part 10. That is, the support member 20 may not be exposed to the first surface of the body part 10. Therefore, when the first electrode 81 is formed on the first surface of the body part 10, a problem such as a plating defect, or the like, may not occur. Further, the second terminal 42 of the second coil 41 and 42, the second conductive via 43 connected to the second terminal 42, and the second insulating film 44 covering the second coil 41 and 42 may be exposed to the second surface of the body part 10. That is, the support member 20 may not be exposed to the second surface of the body part 10. Therefore, when the second electrode 82 is formed on the second surface of the body part 10, a problem such as a plating defect, or the like, may not occur.

Figure 5A:
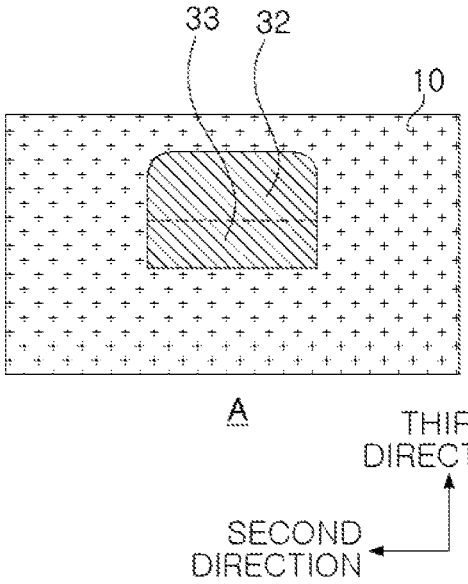
FIGS. 5A and 5B illustrate other examples of the body part of the coil component of FIG. 2 viewed in the A and B directions.
Figure 5B:
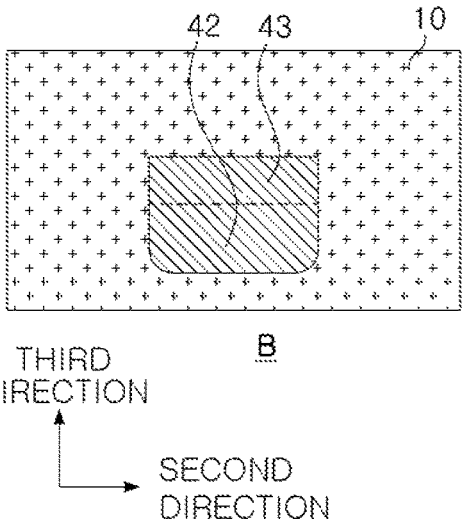

FIGS. 5A and 5B schematically illustrate other examples of the body part 10 of the coil component of FIG. 2 viewed in the A and B directions, respectively. Here, FIG. 5A schematically illustrates the first surface of the body part 10. In addition, FIG. 5B schematically illustrates the second surface of the body part 10. Referring to FIGS. 5A and 5B, only the first terminal 32 of the first coil 31 and 32, and the first conductive via 33 connected to the first terminal 32 may be exposed to the first surface of the body part 10. That is, the first insulating film 34 and the support member 20 may not be exposed to the first surface of the body part 10 in the example of FIG. 5A. The example of FIG. 5A may illustrate a case in which the first insulating film 34 is not formed, or a case in which the first insulating film 34 does not cover an end portion of the first terminal 32 of the first coil 31 and 32. In addition, only the second terminal 42 of the second coil 41 and 42, and the second conductive via 43 connected to the second terminal 42 may be exposed to the second surface of the body part 10. That is, the second insulating film 44 and the support member 20 may not be exposed to the second surface of the body part 10 in the example of FIG. 5B. The example of FIG. 5B illustrates a case in which the second insulating film 44 is not formed, or a case in which the second insulating film 44 does not cover an end portion of the second terminal 42 of the second coil 41 and 42.

Figure 6:
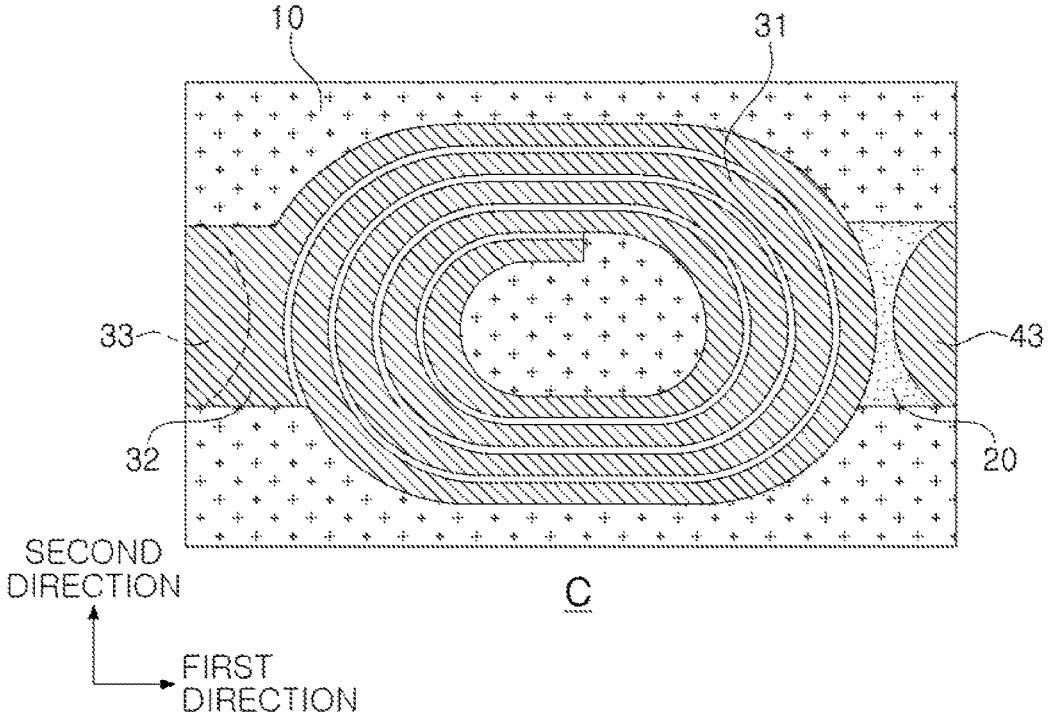
FIG. 6 illustrates a schematic example of a coil part of the coil component of FIG. 2 viewed in a C direction.
Figure 7:
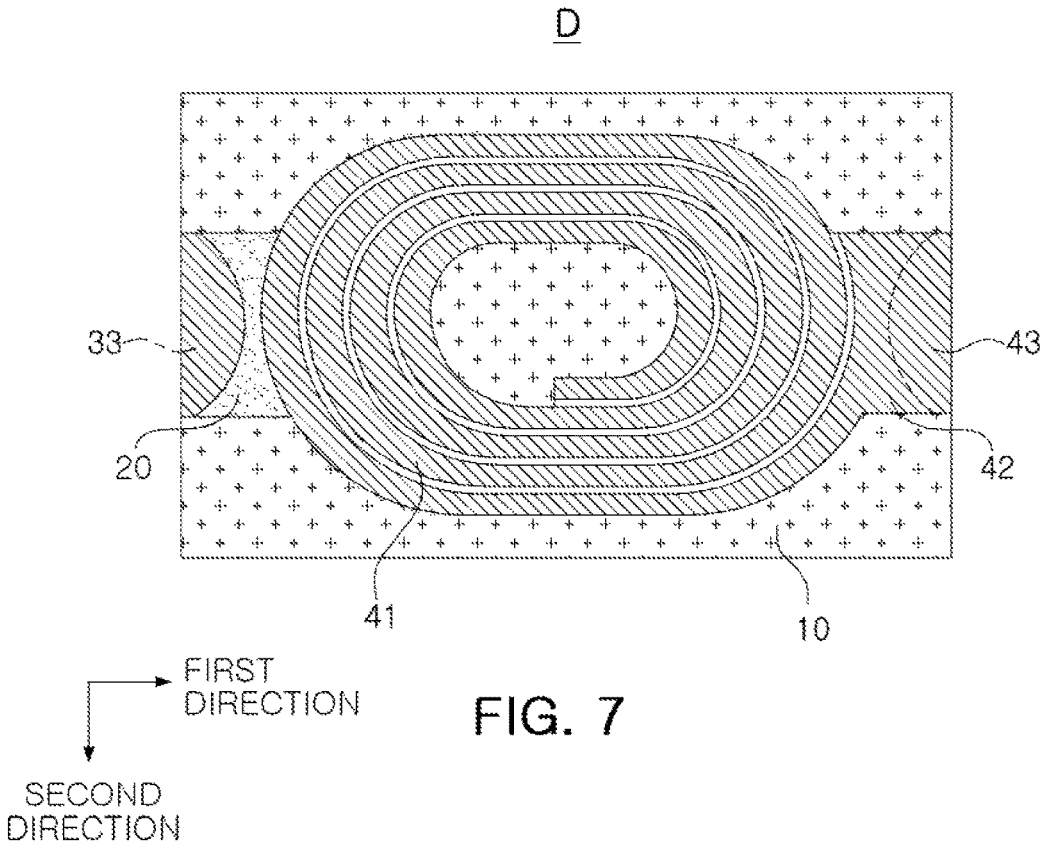
FIG. 7 illustrates a schematic example of the coil part of the coil component of FIG. 2 viewed in a D direction.

FIG. 6 illustrates a schematic example of the coil part 70 of the coil component of FIG. 2 viewed in a C direction. FIG. 7 illustrates a schematic example of the coil part 70 of the coil component of FIG. 2 viewed in a D direction. Referring to FIGS. 6 and 7, the first plating pattern 31 of the first coil 31 and 32 may have a planar coil shape with a plurality of turns. The second plating pattern 41 of the second coil 41 and 42 may also have a planar coil shape with a plurality of turns. The first conductive via 33 may be connected to the first terminal 32 of the first coil 31 and 32, may penetrate through the first end portion of the support member 20, and may completely penetrate through an end surface of the support member 20 contacting the first surface of the body part 10. The second conductive via 43 may be connected to the second terminal 42 of the second coil 41 and 42, may penetrate through the second end portion of the support member 20, and may completely penetrate through an end surface of the support member 20 contacting the second surface of the body part 10.

Meanwhile, although a case in which the one or more electrode part(s) 80 are formed on the first and second surfaces of the body part 10 is illustrated in the accompanying drawings, unlike this, the electrode part 80 may be formed on another surface depending on the kind of coil component. Alternatively, the electrode part 80 may be formed on three or more surfaces. In this case, a terminal of the coil and a conductive via of the coil part 70 may be added in accordance therewith. Further, the coil of the coil part 70 may be formed on only one surface of the support member or may be composed of a plurality of coil layers. Besides, the coil part 70 may be modified in various forms.

Figure 8:
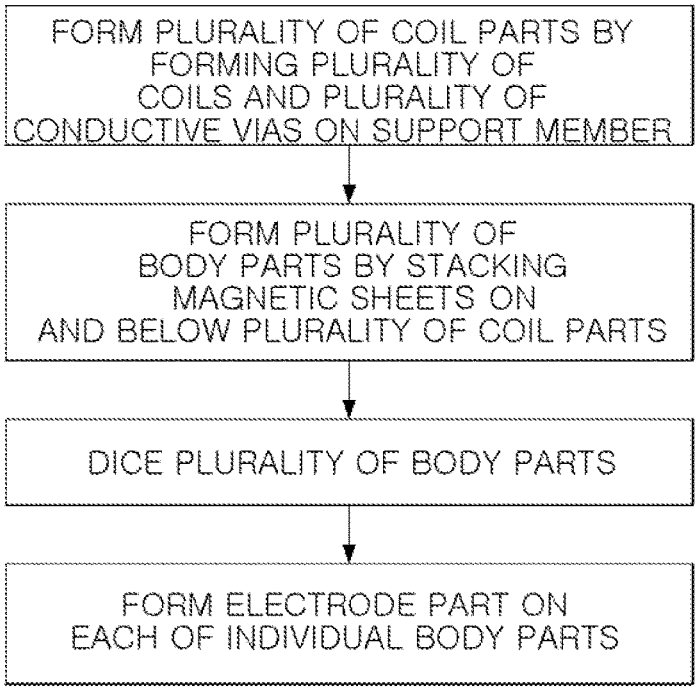
FIG. 8 is a schematic process flow chart showings steps of an illustrative method for manufacturing the coil component of FIG. 2.

FIG. 8 is a schematic process flow chart showings steps of an illustrative method for forming the coil component of FIG. 2. Referring to FIG. 8, a method of manufacturing the coil component 100A according to the example may include forming a plurality of coil parts by forming a plurality of coils and a plurality of conductive vias on a support member; forming a plurality of body parts by stacking magnetic sheets on top of and below the plurality of coil parts; dicing the plurality of body parts; and forming one or more electrode part(s) on each of the individual body parts. A plurality of coil components may be manufactured by a single process through a series of operations.

FIGS. 9, 10, 12, 13, 14, and 15 illustrate examples of schematic process steps of methods for manufacturing or forming the coil component of FIG. 2. FIGS. 11A through 11D illustrate a schematic enlarged cross-section of part P of the coil component of FIG. 10. Hereinafter, a description overlapping the description above will be omitted, and each of the processes in the method of manufacturing the coil component will be described in more detail with reference to FIGS. 9, 10, 11A through 11D, 12, 13, 14, and 15.

Figure 9:
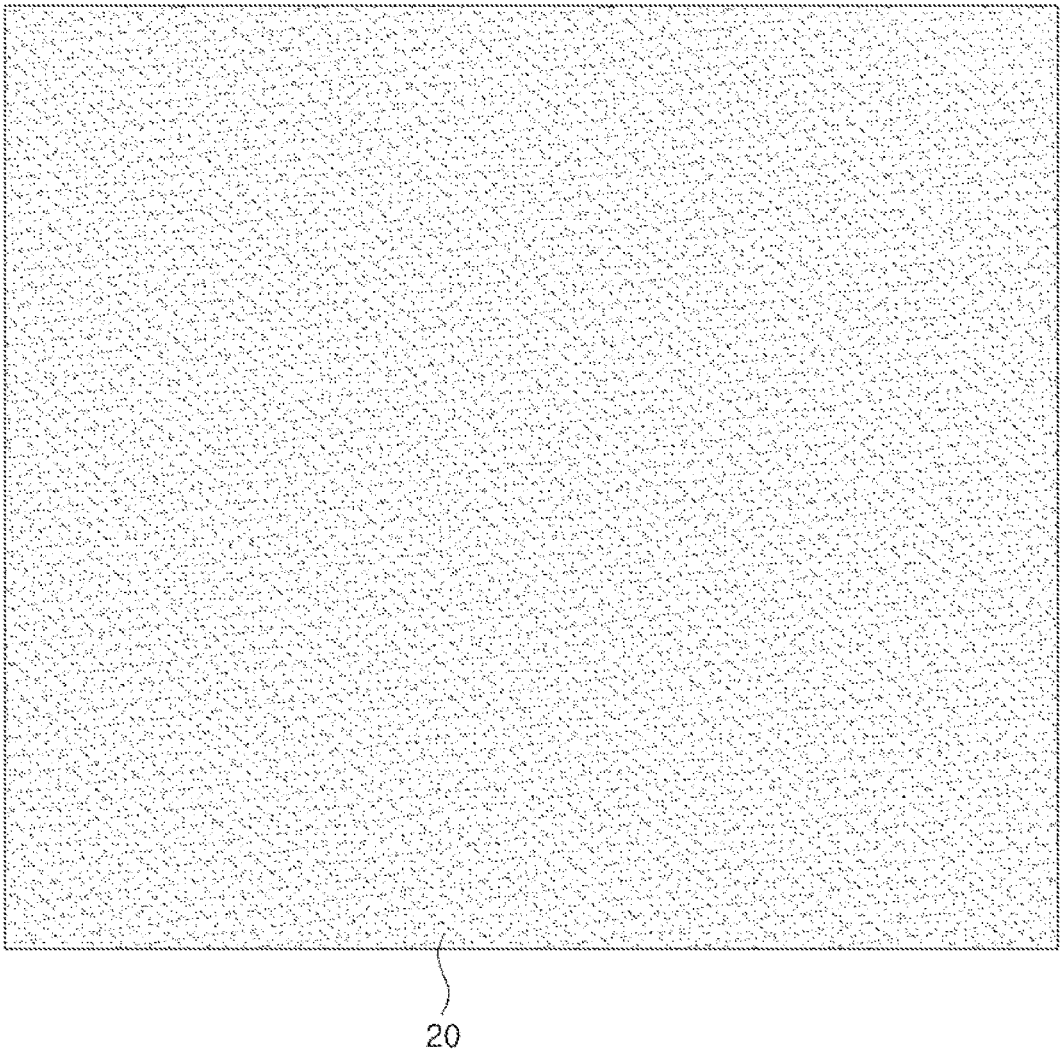
FIGS. 9, 10, 12, 13, 14, and 15 illustrate examples of schematic process steps of methods for manufacturing the coil component of FIG. 2.

Referring to FIG. 9, a support member 20 may be prepared. In some examples, unlike the support member illustrated in FIG. 9, a plurality of metal layers (not illustrated) may be disposed on both opposing main surfaces of the support member 20. In such examples, the plurality of metal layers (not illustrated) may be used as seed layers when a coil is formed on the support member 20, or the like. In one example, the support member 20 may be a portion of a general copper clad laminate (CCL), but is not limited thereto.

Figure 10:
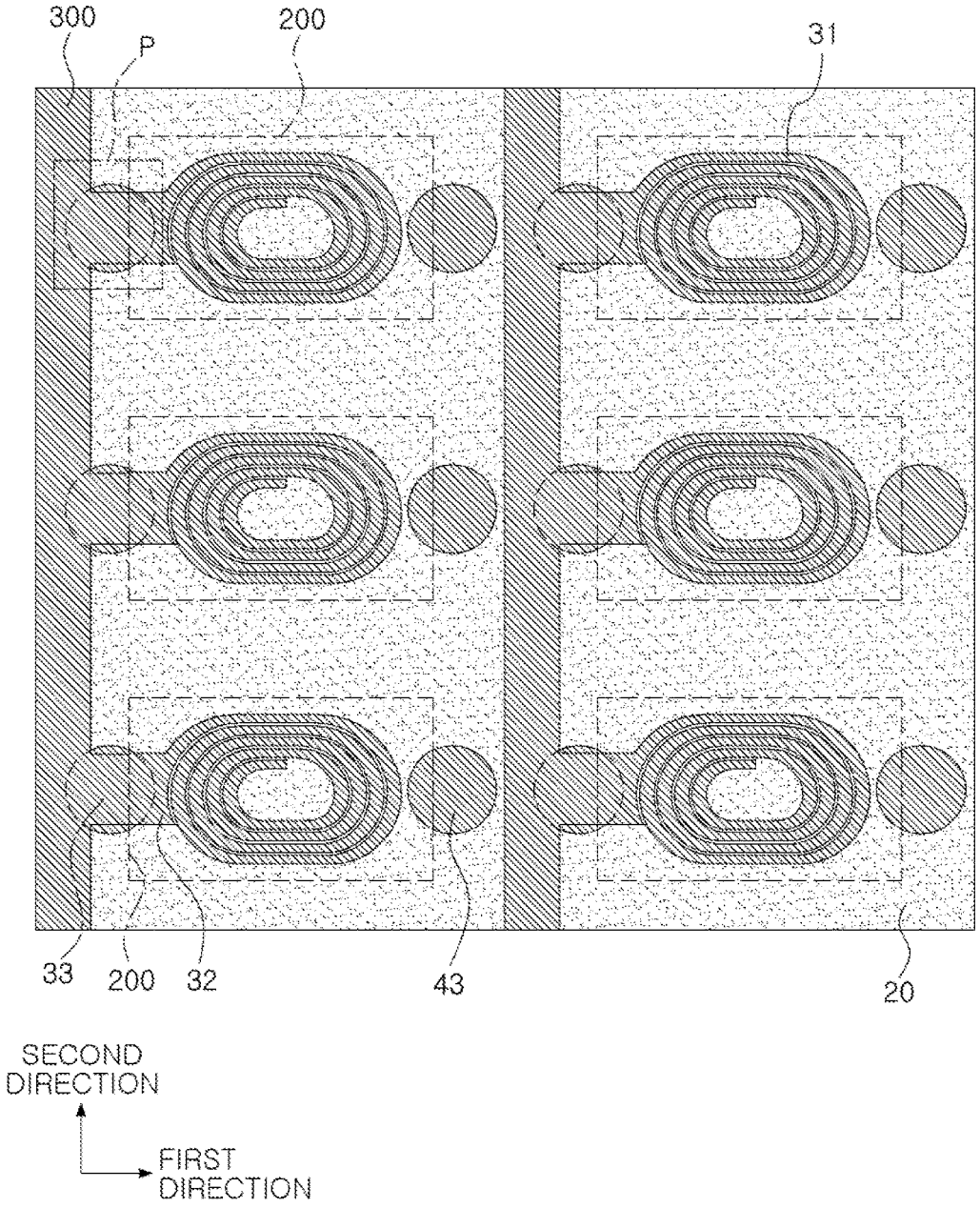

Referring to FIG. 10, the plurality of coil parts 70 may be formed by forming a plurality of first coils 31 and 32 and a plurality of second coils 41 and 42 on respective surfaces of the support member 20, and forming a plurality of first conductive vias 33 and a plurality of second conductive vias 43 penetrating through the support member 20. The plurality of coil parts 70 may be formed, for example, by forming a dry film, patterning the dry film by a photolithography method, and filling a patterned portion using a plating method. However, the formation method of the coil parts 70 is not limited thereto. The plating method may be an electrolytic copper plating method, an electroless copper plating method, or the like. In more detail, the plurality of coil parts 70 may be formed using a chemical vapor deposition (CVD) method, a physical vapor deposition (PVD) method, a sputtering method, a subtractive method, an additive method, a semi-additive process (SAP), a modified semi-additive process (MSAP), or the like, but are not limited thereto. Via holes for the first and second conductive vias 33 and 43 may be formed using a mechanical drill, a laser drill, and/or the like, before plating. The plurality of coil parts 70 may be connected to each other by a support pattern 300, and may be separated from each other by dicing the plurality of coil parts 70 along each dicing line 200.

Figure 11A:
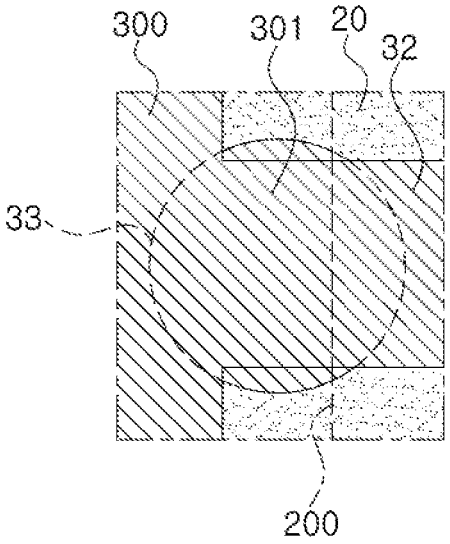
FIGS. 11A through 11D illustrate a schematic enlarged cross-section of the part P of the coil component of FIG. 10.
Figure 11B:
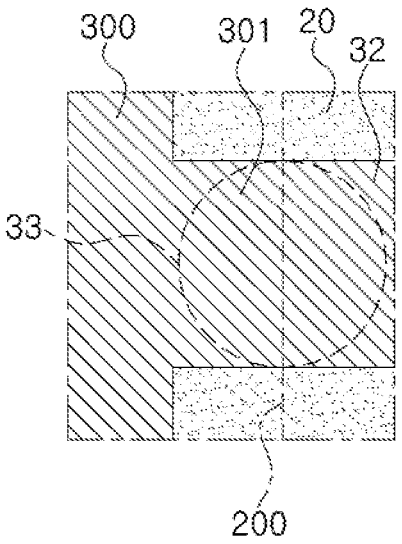
Figure 11C:
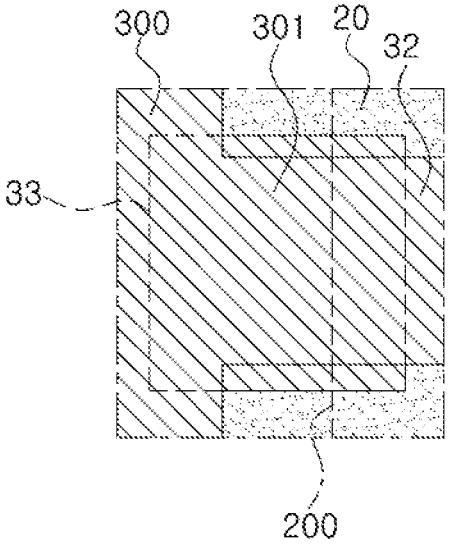
Figure 11D:
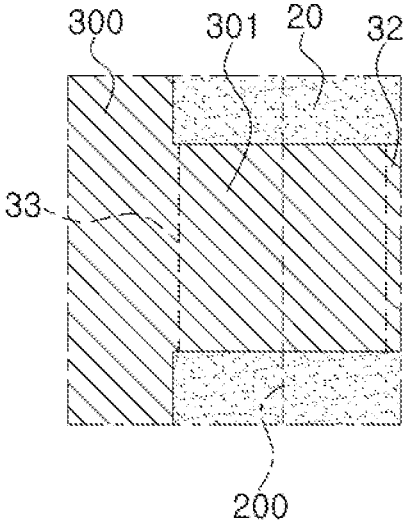

Referring to FIGS. 11A through 11D, the conductive vias 33 and 43 may have any shape as long as they penetrate through an end portion of the support member 20 so as to not be exposed to an outer surface of a body 10 after the support member 20 is diced along the dicing line 200. For example, as illustrated in FIG. 11A, a horizontal cross-sectional shape of the conductive vias 33 and 43 may be a circle, and a diameter thereof may be larger than a line width of the terminals 32 and 42 of the coils 31, 32, 41, and 42. Further, as illustrated in FIG. 11B, the horizontal cross-sectional shape of the conductive vias 33 and 43 may be a circle, and a diameter thereof may be equal to the line width of the terminals 32 and 42 of the coils 31, 32, 41, and 42. In addition, as illustrated in FIG. 11C, the horizontal cross-sectional shape of the conductive vias 33 and 43 may be a tetragon, and a width thereof may be larger than the line width of the terminals 32 and 42 of the coils 31, 32, 41, and 42. Further, as illustrated in FIG. 11D, the horizontal cross-sectional shape of the conductive vias 33 and 43 may be a tetragon, and a width thereof may be equal to the line width of the terminals 32 and 42 of the coils 31, 32, 41, and 42. However, the conductive vias illustrated in FIGS. 11A through 11D are provided by way of example, and the conductive vias may have different shapes or sizes, or the like. Portions of the conductive vias 33 and 43 formed on connection portions 301, and the like, of the support pattern 300 may be removed during dicing of the support member 20 along the dicing line 200, and thus the portions may not remain after the individual coil component 100A is manufactured.

Figure 12:
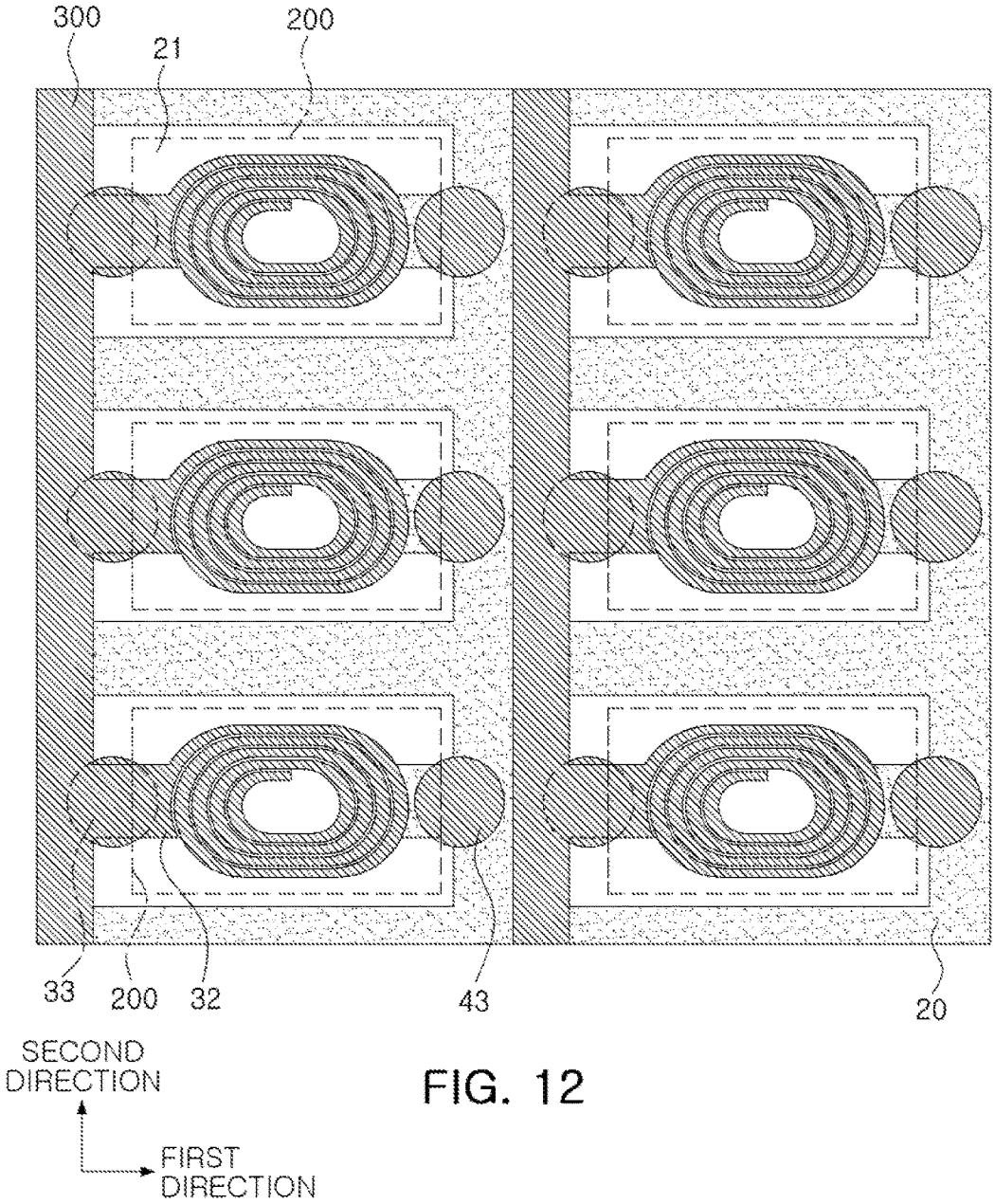

Referring to FIG. 12, in a region expanded to be wider than an area enclosed by each of the dicing lines 200, the other regions of the support member 20 except for a region of the support member 20 on which each of the coil parts 70 is formed may be removed by a trimming method, and thus regions 21 from which the support member 20 is removed may be formed. As the trimming method, any method may be used without particular limitation as long as it may selectively remove the support member 20 as described above. In addition, the removal method is not limited thereto, and the support member 20 may also be selectively removed by another method in addition to the trimming method.

Figure 13:
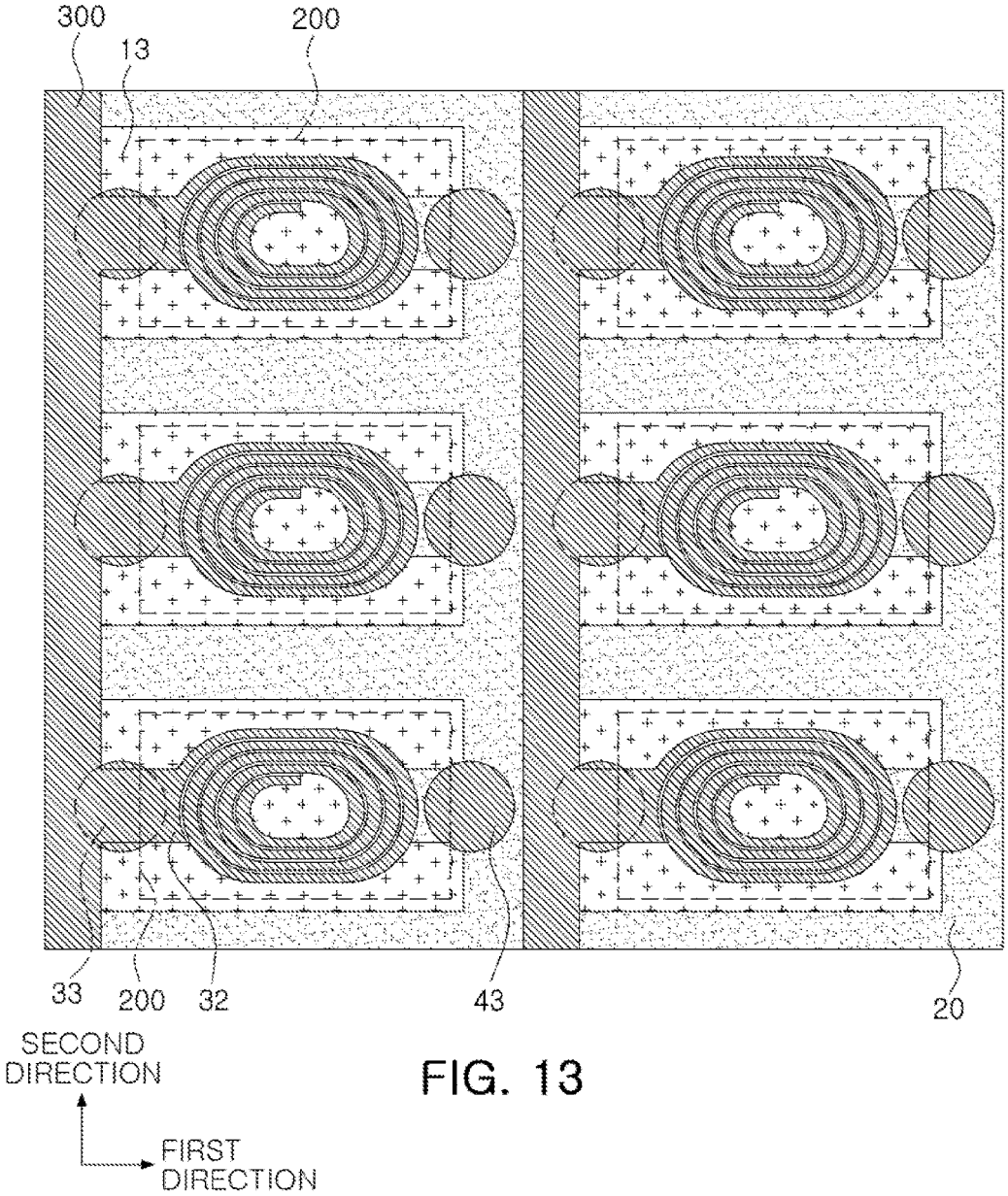

Referring to FIG. 13, a plurality of body parts 10 embedding the plurality of coil parts 70 may be formed by filling the regions in which the support member 20 is removed by the trimming method, or the like, with a magnetic material 13. This may be performed by compressing and curing magnetic sheets (not illustrated). For example, the plurality of body parts 10 may be formed by compressing the magnetic sheets on top of and below the plurality of coil parts 70, respectively, and then curing the compressed magnetic sheets. However, the plurality of body parts 10 are not limited thereto, and may be formed by providing the magnetic material 13 using a different method.

Figure 14:
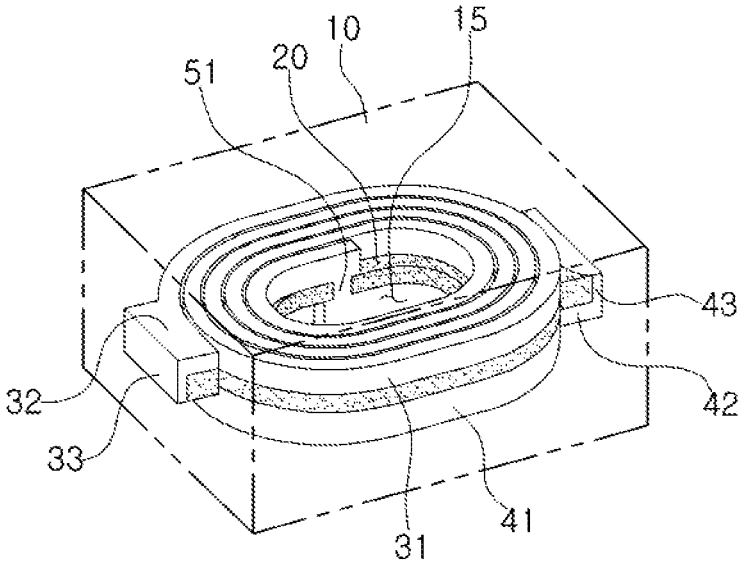

Referring to FIG. 14, individual body parts 10 may be obtained by dicing the plurality of body parts 10 along the dicing line(s) 200. The dicing may be performed in accordance with a size designed in advance, and as a result, a plurality of body parts 10 in which the coil part 70 is disposed may be provided. The dicing may be performed using dicing equipment. In addition, another dicing method such as a blade method, a laser method, or the like, may be used. After dicing, although not illustrated in detail in the drawings, edges of the body part 10 may be formed in a round shape by polishing the edges of the body part 10, and in order to prevent plating, an insulator (not illustrated) for insulation may be printed on an outer surface of the body part 10.

Figure 15:
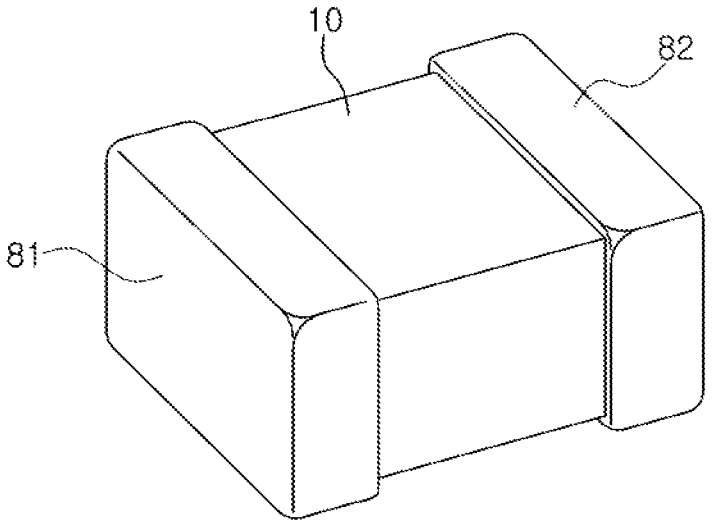

Referring to FIG. 15, a coil component may be obtained by forming one or more electrode(s) 80 on each of the individual body parts 10. The electrode(s) 80 may be first and second electrodes 81 and 82 and formed using a suitable method. For example, the electrodes 80 may be formed by printing a paste containing a metal having excellent conductivity using a dipping method, or the like, and then plating a metal having excellent conductivity using a plating method, but a formation method of the electrodes 80 is not limited thereto. If necessary, a pre-plating layer (not illustrated) may be formed by a plating method before forming the electrodes 80.

Figure 16:
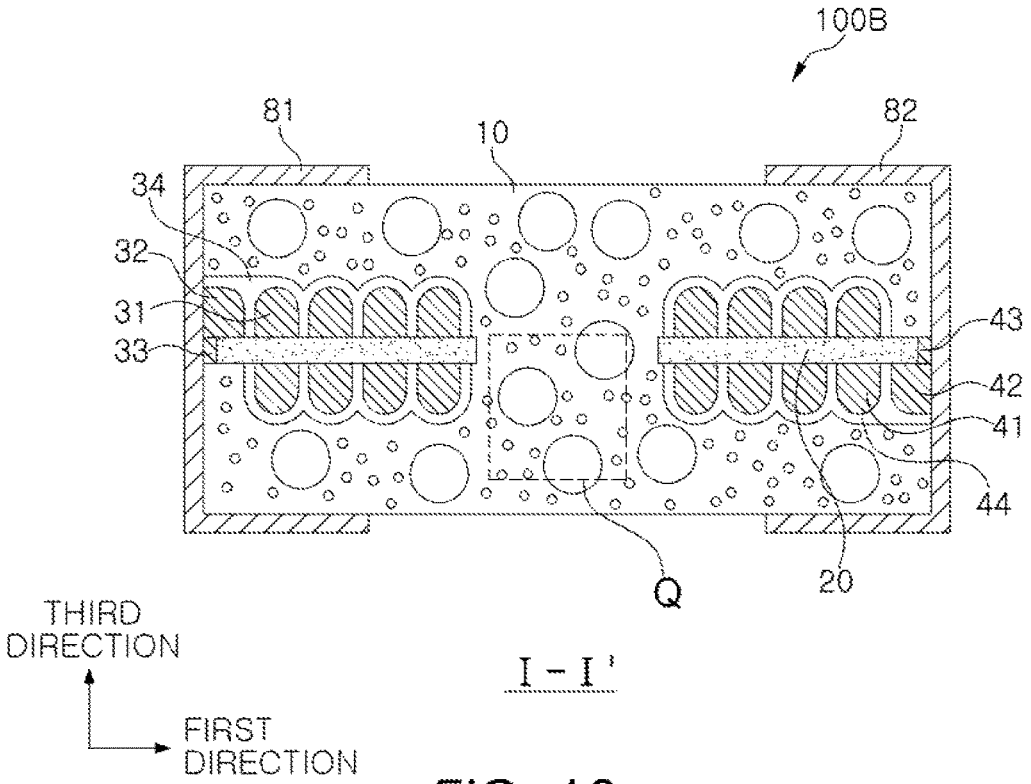
FIG. 16 illustrates another example of the schematic cross-section of the coil component of FIG. 2 taken along line I-I'.
Figure 17:
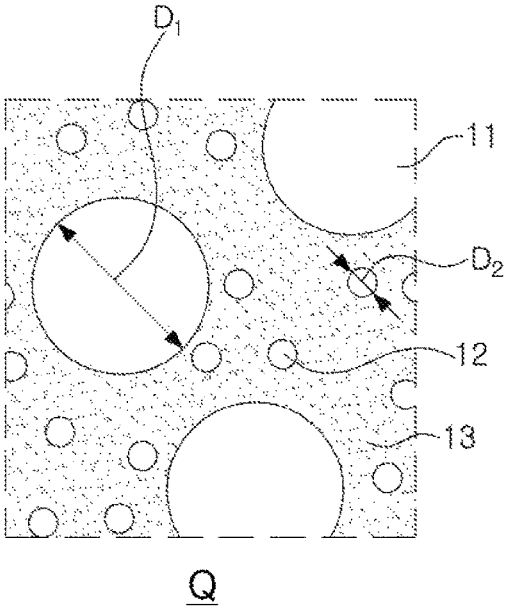
FIG. 17 illustrates a schematic enlarged cross-section of part Q of the coil component of FIG. 16.

FIG. 16 illustrates another example of the schematic cross-section of the coil component taken along line I-I' of FIG. 2. FIG. 17 illustrates a schematic enlarged cross-section of part Q of the coil component of FIG. 16. Referring to FIGS. 16 and 17, in a coil component 100B according to another example, a magnetic material of a body part 10 may be a magnetic material-resin composite in which magnetic metal powders 11 and 12 and a resin mixture 13 are mixed with each other. The magnetic metal powders 11 and 12 may contain iron (Fe), chromium (Cr), or silicon (Si) as a main ingredient. For example, the magnetic metal powders 11 and 12 may contain iron (Fe)-nickel (Ni), iron (Fe), iron (Fe)-chromium (Cr)-silicon (Si), or the like, but are not limited thereto. The resin mixture 13 may contain epoxy, polyimide, a liquid crystal polymer (LCP), or the like, but is not limited thereto. As the magnetic metal powders 11 and 12, magnetic metal powders 11 and 12 having at least two average particle sizes $D_1$ and $D_2$ different from each other may be used. In this case, the magnetic material-resin composite may be fully filled by using bimodal magnetic metal powders 11 and 12 having different sizes and compressing the bimodal magnetic metal powders 11 and 12, and thus a filling rate may be increased. Since other configurations are the same as those described above, a description thereof will be omitted.

Figure 18:
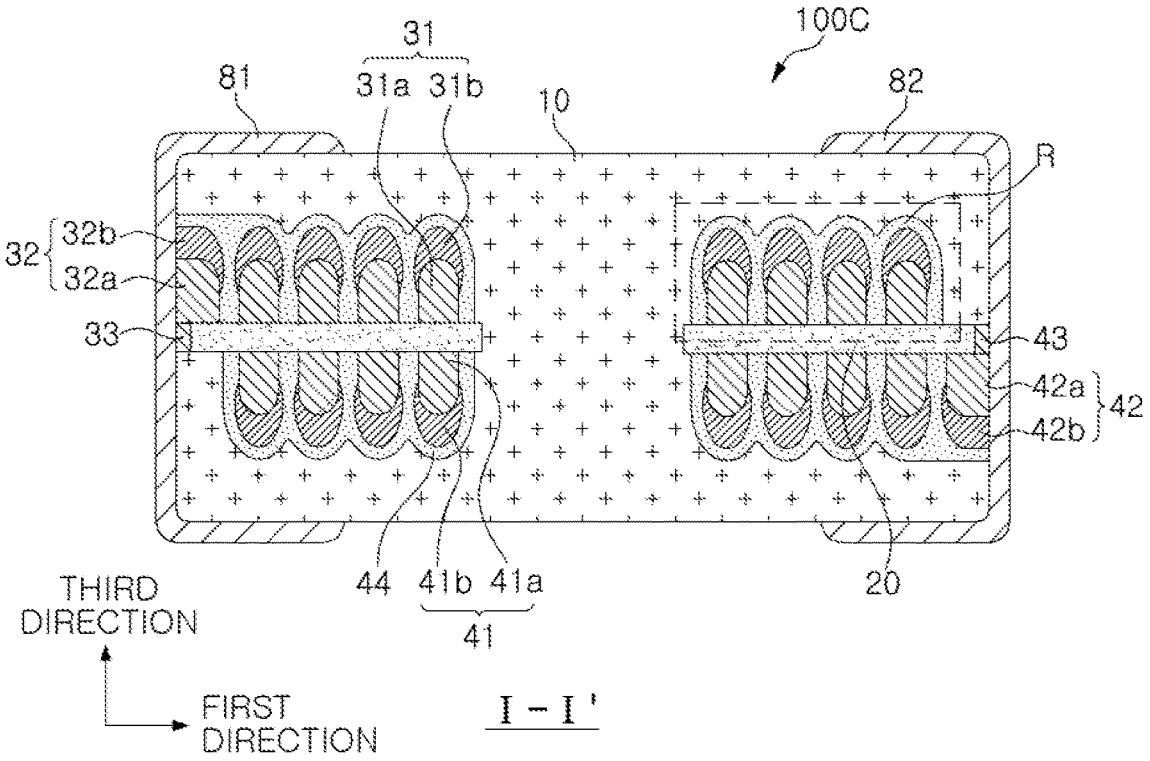
FIG. 18 illustrates another example of the schematic cross-section of the coil component of FIG. 2 taken along line I-I'.
Figure 19:
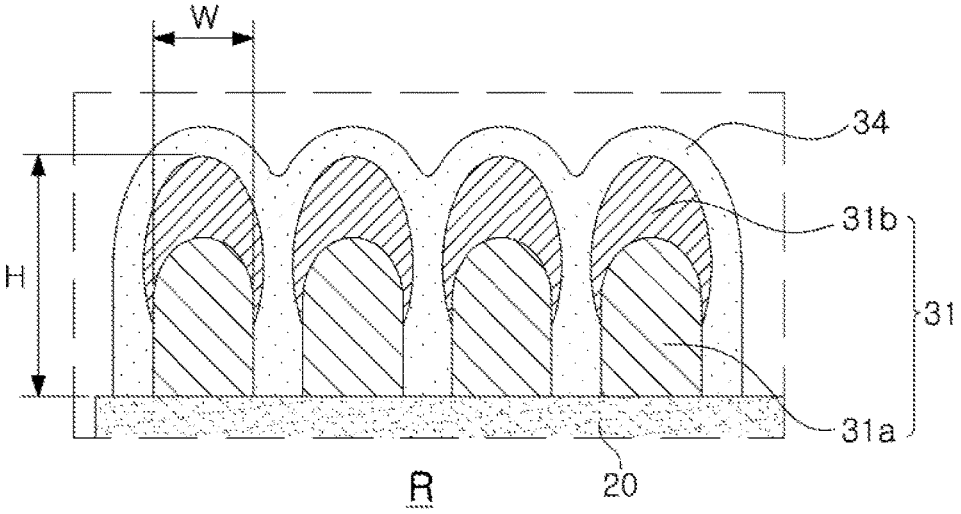
FIG. 19 illustrates a schematic enlarged cross-section of part R of the coil component of FIG. 18.

FIG. 18 illustrates another example of the schematic cross-section of the coil component taken along line I-I' of FIG. 2. FIG. 19 illustrates a schematic enlarged cross-section of part R of the coil component of FIG. 18. Referring to FIGS. 18 and 19, in a coil component 100C according to another example, coils 31, 32, 41, and 42 may be formed by applying an anisotropic plating technology. In this case, the coils 31, 32, 41, and 42 may be composed of a plurality of plating patterns 31*a*, 31*b*, 32*a*, 32*b*, 41*a*, 41*b*, 42*a*, and 42*b*, respectively, and thus, a high aspect ratio (AR), which is a ratio of a height H to a line width W, may be implemented. In this case, the height H may be measured orthogonally to a main surface of the support member 20, and the line width W may be measured across the width of the coil plating pattern 31 along a plane parallel to the main surface of the support member 20. As a result, high inductance may be implemented. Since other configurations are the same as those described above, a description thereof will be omitted.

Figure 20:
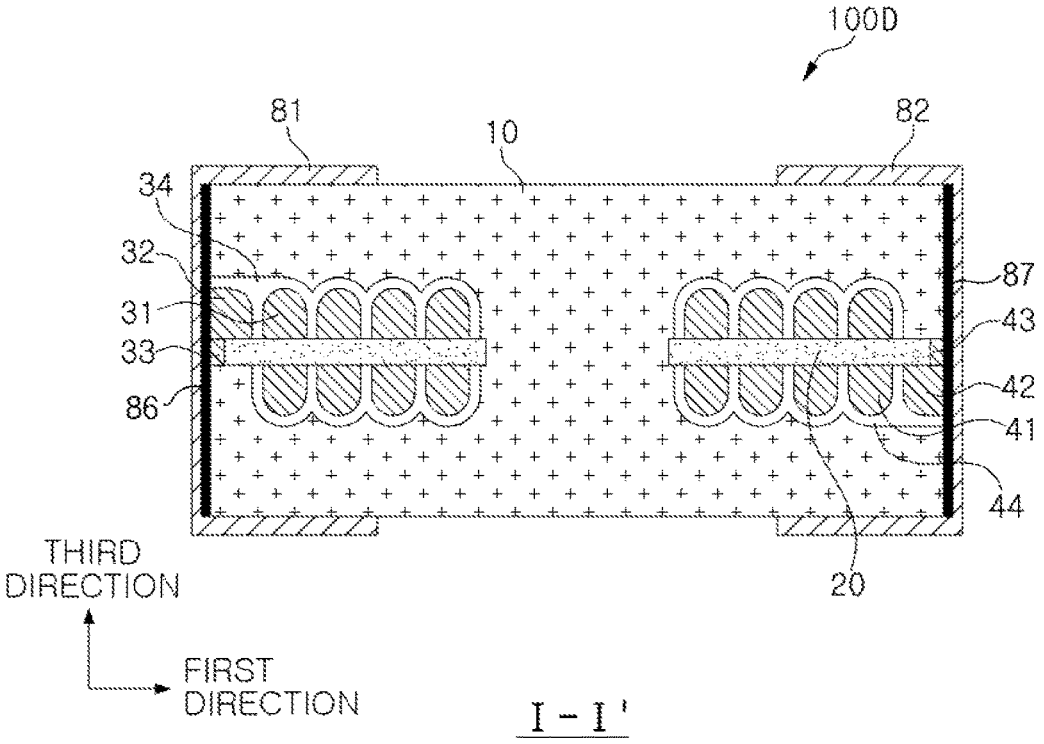
FIG. 20 illustrates another example of the schematic cross-section of the coil component of FIG. 2 taken along line I-I'.

FIG. 20 illustrates another example of the schematic cross-section of the coil component taken along line I-I' of FIG. 2. Referring to FIG. 20, one or more electrode part(s) 80 may include pre-plating layers 86 and 87 provided in order to improve electrical reliability of the electrical connection between the coil part 70 and each electrode part 80. The pre-plating layers 86 and 87 may include a first pre-plating layer 86 disposed on a first terminal 32 of a first coil 31 and 32 and a first conductive via 33 to connect the first terminal 32 and the first conductive via 33 to a first electrode 81, and a second pre-plating layer 87 disposed on a second terminal 42 of a second coil 41 and 42 and a second conductive via 43 to connect the second terminal 42 and the second conductive via 43 to a second electrode 82. Since other configurations are the same as those described above, a description thereof will be omitted.

The first pre-plating layer 86 may be disposed on the first terminal 32 of the first coil 31 and 32 and the first conductive via 33 exposed to a first surface of a body part 10. In some cases, a portion of the first pre-plating layer 86 may be disposed inwardly of the first surface of the body part 10. The first pre-plating layer 86 may be formed of a conductive material, such as copper (Cu) plating. The first electrode 81 may be formed by applying at least one of nickel (Ni) and tin (Sn) to the first pre-plating layer 86, or may be formed by applying at least one of silver (Ag) and copper (Cu) to the first pre-plating layer 86 and then applying at least one of nickel (Ni) and tin (Sn) thereto. Therefore, contact force of the first electrode 81 may be increased, and silver (Ag), copper (Cu), and the like, for forming the first electrode 81 do not need to be separately applied.

The second pre-plating layer 87 may be disposed on the second terminal 42 of the second coil 41 and 42 and the second conductive via 43 exposed to a second surface of the body part 10. In some cases, a portion of the second pre-plating layer 87 may be disposed inwardly of the second surface of the body part 10. The second pre-plating layer 87 may be formed of a conductive material, such as copper (Cu) plating. The second electrode 82 may be formed by applying at least one of nickel (Ni) and tin (Sn) to the second pre-plating layer 87, or may be formed by applying at least one of silver (Ag) and copper (Cu) to the second pre-plating layer 87 and then applying at least one of nickel (Ni) and tin (Sn) thereto. Therefore, contact force of the second electrode 82 may be increased, and silver (Ag), copper (Cu), and the like, for forming the second electrode 82 do not need to be separately applied.

Figure 21:
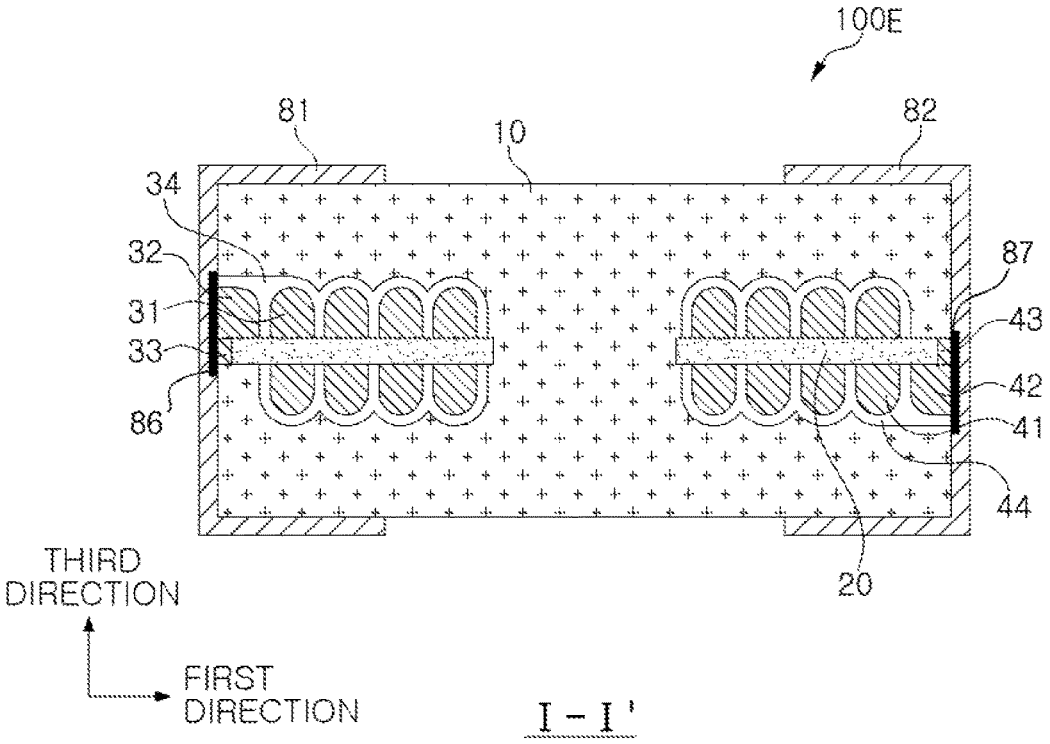
FIG. 21 illustrates another example of the schematic cross-section of the coil component of FIG. 2 taken along line I-I'.

FIG. 21 illustrates another example of the schematic cross-section of the coil component taken along line I-I' of FIG. 2. Referring to FIG. 21, one or more electrode part(s) 80 may include pre-plating layers 86 and 87 in order to improve electrical reliability of the electrical connection between the coil part 70 and the electrode part 80. In this case, the pre-plating layers 86 and 87 do not entirely cover first and second surfaces of a body part 10 but may cover only terminals 32 and 42 of coils 31, 32, 41, and 42 and conductive vias 33 and 43, unlike the pre-plating layers illustrated in FIG. 20. However, a disposition form of the pre-plating layers 86 and 87 is not limited thereto, and the pre-plating layers 86 and 87 may also be disposed in another form as long as the pre-plating layers 86 and 87 cover only the terminals 32 and 42 of the coils 31, 32, 41, and 42 and the conductive vias 33 and 43. Since other configurations are the same as those described above, a description thereof will be omitted.

As set forth above, in accordance with the exemplary embodiments described herein, the coil component having a novel structure capable of decreasing plating defects, or the like, by allowing the insulating substrate not to be exposed to the outer surface of the body on which the electrode is formed, and the method of manufacturing the same capable of efficiently manufacturing the coil component are provided.

Meanwhile, in the present disclosure, a word 'electrically connected' includes both a case in which one component is physically connected to another component and a case in which a component is not physically connected to another component.

In addition, a term 'examples' used in the present disclosure does not mean the same exemplary embodiment, but is provided in order emphasize and describe different unique features. However, each of the above suggested examples may also be implemented to be combined with a feature of another example. For example, even though a content described in a specific example is not described in another example, it may be understood as a description related to another example unless explicitly described otherwise.

Further, terms used in the present disclosure are used only in order to describe an example rather than limiting the present disclosure. Here, singular forms include plural forms unless a context clearly indicates otherwise.

While exemplary embodiments have been shown and described above, it will be apparent to those skilled in the art that modifications and variations could be made without departing from the scope of the present invention as defined by the appended claims.

What is claimed is:

1. A coil component comprising:

a body part containing a magnetic material;

a coil part disposed in the body part; and an electrode part disposed on the body part, wherein the coil part includes:

a support member;

a coil disposed on a surface of the support member in a planar coil pattern and having a terminal exposed to at least one outer surface of the body part; and a conductive via connected to the terminal of the coil and disposed adjacent to at least one end portion of the support member to thereby be exposed to the at least one outer surface of the body part to which the terminal is exposed, wherein the support member is not exposed to any outer surface of the body part.

2. The coil component of claim 1, wherein the coil has a plating pattern disposed on the surface of the support member and having a planar coil shape.

3. The coil component of claim 1, wherein the support member contains glass fiber and an insulating resin.

4. The coil component of claim 1, wherein the coil part further includes an insulating film enclosing the coil.

5. The coil component of claim 1, wherein the conductive via is integrated with the terminal of the coil.

6. The coil component of claim 5, wherein the conductive via and the coil each contain copper (Cu).

7. The coil component of claim 1, wherein the magnetic material contains magnetic metal powder and a resin mixture.

8. The coil component of claim 7, wherein the magnetic metal powder comprises a plurality of magnetic metal powders having average particle sizes that are different from each other.

9. The coil component of claim 1, wherein the electrode part includes an electrode connected to the terminal of the coil and to the conductive via which is exposed to the at least one outer surface of the body part.

10. The coil component of claim 9, wherein the electrode part further includes a pre-plating layer formed on the terminal of the coil and the conductive via to connect the terminal of the coil and the conductive via to the electrode.

11. The coil component of claim 1, wherein the coil includes a first coil disposed on a first surface of the support member and having a first terminal exposed to a first outer surface of the body part, and a second coil disposed on a second surface of the support member opposite to the first surface of the support member and having a second terminal exposed to a second outer surface of the body part opposite to the first outer surface of the body part, the conductive via includes a first conductive via connected to the first terminal of the first coil and penetrating through a first end portion of the support member to thereby be exposed to the first outer surface of the body part, and a second conductive via connected to the second terminal of the second coil and disposed adjacent to a second end portion of the support member to thereby be exposed to the second outer surface of the body part, each of the first coil and the second coil has a plating pattern respectively disposed on the first and second surface of the support member and having a planar coil shape.

12. The coil component of claim 11, wherein the electrode part includes:

a first electrode connected to the first terminal of the first coil and the first conductive via which are exposed to the first outer surface of the body part; and a second electrode connected to the second terminal of the second coil and the second conductive via which are exposed to the second outer surface of the body part, wherein the first and second electrodes cover the first and second outer surfaces of the body part, respectively.

13. The coil component of claim 11, wherein the coil part further includes a through via penetrating through the support member and connecting the first and second coils to each other.

14. A coil component comprising:

a support member;

a coil disposed in a planar coil pattern on a surface of the support member; and a body part containing a magnetic material and enclosing the coil and the support member, wherein the coil includes at least one coil terminal exposed to an outer surface of the body part, and wherein the support member is spaced apart from the outer surface of the body part to which the coil terminal is exposed with a conductive via, wherein the support member is not exposed to any outer surface of the body part.

15. The coil component of claim 14, wherein:

the support member is spaced apart from a first outer surface of the body part on which the coil terminal is exposed by a first conductive via, and the support member is spaced apart from a second outer surface of the body part opposite to the first outer surface of the body part by a second conductive via.

16. The coil component of claim 14, wherein the support member is an insulating substrate formed of an insulating resin and a glass fiber.

17. The coil component of claim 14, wherein the magnetic material of the body part is a magnetic material-resin composite in which the magnetic material includes at least two different magnetic metal powders having different average particle sizes.

18. The coil component of claim 14, wherein the coil includes a first plating pattern disposed in the planar coil pattern directly on the surface of the support member and a second plating pattern spaced apart from the support member and disposed in the planar coil pattern on the first plating pattern.

19. The coil component of claim 14, further comprising:

an electrode disposed on the body part to cover the outer surface of the body part on which the coil terminal is exposed; and a pre-plating layer disposed between the electrode and the coil terminal, wherein the support member is spaced apart from the outer surface of the body part on which the coil terminal is exposed by a conductive via, and the pre-plating layer is disposed between the electrode and the conductive via.

20. The coil component of claim 14, wherein the support member is spaced apart by a conductive via from the outer surface of the body part on which the coil terminal is exposed, such that the conductive via is disposed between the support member and the outer surface of the body part on which the coil terminal is exposed.

21. The coil component of claim 20, wherein the support member is a substantially planar support member having the coil disposed thereon, and the conductive via directly contacts the support member and is disposed in a plane of the support member between the support member and the outer surface of the body part on which the coil terminal is exposed.

* * * * *